US006723253B2

(12) United States Patent
Casado Domínguez et al.

(10) Patent No.: US 6,723,253 B2
(45) Date of Patent: Apr. 20, 2004

(54) DOMESTIC TREATMENT OF FABRICS WITH FILM-FORMING MATERIALS AND BLOWING AGENTS

(75) Inventors: Arturo Luis Casado Domínguez, Brussels (BE); Markus Wilhelm Altmann, Brussels (BE); Bruno Albert Jean Hubesch, Neerijse-Huldenberg (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/040,103

(22) Filed: Oct. 19, 2001

(65) Prior Publication Data

US 2002/0130295 A1 Sep. 19, 2002

(51) Int. Cl.[7] ..... D06M 13/50; D06M 11/58; D06M 11/76; D06C 15/00

(52) U.S. Cl. ..... 252/8.91; 252/8.61; 38/144; 427/370; 427/393.2

(58) Field of Search ..... 252/8.91, 8.61; 38/144; 427/370, 393.2

(56) References Cited

U.S. PATENT DOCUMENTS

| | | | | |
|---|---|---|---|---|
| 4,495,227 A | | 1/1985 | Tanaka | |
| 5,288,421 A | | 2/1994 | Mandy | |
| 5,368,920 A | * | 11/1994 | Schortmann | 442/76 |
| 5,389,386 A | * | 2/1995 | Winston et al. | 424/717 |
| 6,495,058 B1 | * | 12/2002 | Frankenbach et al. | 252/8.91 |

FOREIGN PATENT DOCUMENTS

| | | | |
|---|---|---|---|
| EP | 0 537 648 A2 | | 4/1993 |
| JP | 54-90367 | * | 7/1979 |
| JP | 58-120884 | * | 7/1983 |
| JP | 3-64337 | * | 3/1991 |
| JP | 4-57971 | * | 2/1992 |
| WO | WO 95/28462 A1 | | 10/1995 |

OTHER PUBLICATIONS

Derwent Abstract No. 1976–88054X, abstract of Japanese Patent Specification No. 76–038824 (Oct. 1976).*

Derwent Abstract No. 1983–09073K, abstract of Soviet Union Patent Specification No. 912,795 (Mar. 1982).*

Derwent Abstract No. 1986–171610, abstract of Japanese Patent Specification No. 61–102484 (Oct. 1984).*

* cited by examiner

*Primary Examiner*—Anthony J. Green
(74) *Attorney, Agent, or Firm*—Mark A. Charles; Jason J. Camp; Kim William Zerby

(57) ABSTRACT

Fabrics are treated with a film-forming material and a blowing agent, typically ammonium carbonate or bicarbonate, and ironed. The fabrics thus acquire dry wrinkle resistance, in addition to the benefit provided by the film-forming material.

6 Claims, No Drawings

DOMESTIC TREATMENT OF FABRICS WITH FILM-FORMING MATERIALS AND BLOWING AGENTS

TECHNICAL FIELD

The invention relates to the treatment of fabrics. The fabrics are treated with a film-forming material and a blowing agent selected from the group consisting of ammonium carbonate, ammonium bicarbonate, group metal 1 bicarbonates, and mixtures thereof.

BACKGROUND

Treatments of fabrics with film-forming materials have been extensively disclosed in the art. A number of film-forming materials can be used to provide a number of benefits to fabrics, such as softness, water-repellency, de-wrinkling, wrinkle-resistance, shape retention for non-wovens textiles, hand and gloss. Such materials can be applied to fabrics in an industrial context. In contrast, this invention is only concerned with the domestic treatment of fabrics.

It is also a constant goal to try to provide fabrics with dry-wrinkle resistance, i.e. the ability to resist to the formation of wrinkles when the fabrics are dry, waiting to be worn and while worn.

It has now been found that the use of specific blowing agents, together with film-forming materials, provides the benefit of dry-wrinkle resistance in addition to the benefit provided by the film-forming material. The film-forming material and the blowing agent are intimately mixed and provided to the fabrics. It is hypothesized that, when the fabrics are ironed, the heat causes the blowing agent to release small amounts of $CO_2$ in the film deposited on the fabric. The film, hence the fabric, acquires as a result more flexibility and elasticity, and the fabric thus acquires dry-wrinkle resistance.

U.S. Pat. Nos. 4,495,227 and 3,483,024 describe the industrial treatment of fabrics with industrial blowing agents. The referred blowing agents are typically selected from the groups of azo-compounds such as azobisformamide, azobisisobutyronitrile, diazoaminobenzene; N-nitroso-compunds such as N,N'-dimethyl-N,N'-dinitrosol-terephtalamide, N'N'-dinitrosopentamethylenetetramine; and/or sulfonyl hydrazides such as benzenesulfonylhydrazide, 4-toluenesulfonylhydrazide, diphenylsulfon-3,3'-disulfonyl hydrazide or 4,4'-oxy bis(benzenesulfonyl hydrazide. These blowing agents have four important limitations for domestic fabric treatment compositions/applications: (1) toxicity of blowing agents, and toxicity of some released gases such as CO or NO; (2) high decomposition temperature, commonly above 150° C.; (3) reduced solubility in water and some organic solvents; and/or (4) low stability in water under some pH conditions and/or incompatibility with some other ingredients in the compositions such as co-solvents, perfumes, or preservatives.

SUMMARY OF THE INVENTION

In a first embodiment, the invention encompasses a composition for the treatment of fabrics comprising a film-forming material and a blowing agent selected from the group consisting of consisting of ammonium carbonate, ammonium bicarbonate, group metal 1 bicarbonates, and mixtures thereof.

In a second embodiment, the invention encompasses a process which comprises the steps of providing fabrics with a film-forming material and a blowing agent selected from the group consisting ammonium carbonate, ammonium bicarbonate, group metal 1 bicarbonates, and mixtures thereof, then ironing the fabrics.

In a third embodiment, the invention encompasses an article of manufacture comprising a composition for the treatment of fabrics, as above, and usage instructions to use the composition in the process above.

In a fourth embodiment, the present invention encompasses the use of ammonium carbonate, ammonium bicarbonate, group metal 1 bicarbonates, and mixtures thereof, as blowing agents in a fabric treatment composition or process.

DETAILED DESCRIPTION

The present invention utilizes two main ingredients, namely the film-forming material and the blowing agent.

I)—The Film-forming Material:

Suitable film-forming materials herein include polymers, and mixtures thereof, which are able to form a solid film on a surface. However, non-polymeric materials are also suitable. The film may result from evaporation of solvents or as the result of a curing reaction, i.e., polymerization or cross-linking. Such suitable polymers are described in patent application No 99870223.7.

Preferred film-forming materials for use herein are polymers having a deviation of fabric Wrinkle Recovery Angle (WRA) versus water of at least +15.

The WRA Test method is taken from the AATCC 66-1990. This method is an American National Standard method designed for the determination of the wrinkle recovery of woven fabrics, whereby a test specimen, creased and compressed under controlled conditions of time and load, is suspended in the test instrument for a controlled recovery period, after which the recovery angle is measured. Experimental detail on how to measure this WRA is given in AATCC 66-1990, incorporated herein by reference. The WRA method is tested on 100% cotton, woven Oxford pinpoint fabric, free from wrinkles, cut in twelve specimens of 0.59 inch×1.57 inch, six with their long dimension parallel to the warp, and six with their long dimensional parallel to the filling. The test is carried out on cloth conditioned for 24 hours at 21° C. (70° F.) and 65% RH. Three specimens from each set are creased on one side and three on the other. Tweezers are used to place the test specimen between the leaves of the specimen holder (2 superimposed leaves 0.63 inch wide, but of different lengths and fastened together at one end) with one end directly under the 0.71-inch mark. With the tweezers, the exposed end of the specimen is lifted over and looped back to the 0.71-inch mark on the shorter, thin metal leaf and held with the left thumbnail. The holder with the specimen is inserted into a plastic press (2 superimposed leaves of equal length (3.74 inch) and 0.79 inch wide, fastened together at one end) and a weight of 500 g is applied for 5 minutes so that a crease is formed. The plastic press can then be removed and the specimen holder combination can be inserted in the tester with the exposed end of the specimen holder in the mount on the face of the tester. The crease should line up with a spot at the center of the tester disk, and the dangling specimen leg should be lined up immediately with the vertical guide line. In order to eliminate gravitation effects, keep the dangling specimen leg aligned with the vertical guide line during the 5-min recovery period. Adjust every 15 seconds for the first minute, and once a minute thereafter. Five minutes after the removal of the creasing load, the wrinkle recovery value is read to the nearest degree from the scale. The sum is taken of the average recovery for all warp readings and all filling readings and compared with a cloth treated with water.

Components defined by their WRA are well-known in the art. For example, in JAPS, Vol.15, pp.341–349 (1971) as well as in Textile Research Journal, pp. 199–201, February 1970, are given various examples of components defined by a WRA, all of which are included within the scope of the present invention.

The fabric WRA obtained with the tested component is compared with the fabric WRA obtained with water, thereby giving a deviation Δ. A component which provide a Δ of at least positive(+)15, preferably having a Δ within the range of 15–30 is a component suitable for the invention.

The following represents the WRA deviation versus water of different polymers suitable for use in the present invention and according to the above procedure. In each case, numbers are arithmetic averages of 9 replicates and the results are statistically significantly different at 95% confidence level:

| Polymer | Δ WRA |
|---|---|
| IMO 900 | 19 |
| Avalure AC 120 | 21 |
| Luviquat FC 905 | 15 |

IMO 900: Isomaltose Oligosaccharide ex. Showa Sangyo Co.
Avalure AC 120: Polyacrylate ex. BF Goodrich
Luviquat FC 905: copolymer Vinylimidazolium methochloride & Vinylpyrrolidone ex. BASF Preferred components which have a deviation of fabric WRA versus water of at least 15 are selected from a) shape retention polymers, b) polymers comprising at least one unit which provide a dye transfer inhibiting benefit, c) polyurethanes, d) Isomaltooligosaccharide, e) polyamine polymers, f) amphoteric polymers, g) curable silicones, and mixtures thereof. Most preferred are the materials which are water-soluble. Furthermore, as used herein, the word "component" is meant to include compounds having a WRA deviation versus water of at least 15, mixtures of such components as well as mixtures of components which per se do not have a WRA deviation versus water of at least 15 but which, in combination do have a WRA deviation versus water of at least 15. One such component is disclosed and claimed in co-pending application EP 99870222.9-2413.

a)—Shape Retention Polymer

Suitable shape retention polymers can be natural, or synthetic, and can act by forming a film, and/or by providing adhesive properties. E.g., the present invention can optionally use film-forming and/or adhesive polymer to impart shape retention to fabric, particularly clothing. By "adhesive" it is meant that when applied as a solution or a dispersion to a fiber surface and dried, the polymer can attach to the surface. The polymer can form a film on the surface, or when residing between two fibers and in contact with the two fibers, it can bind the two fibers together. Other polymers such as Isomaltose Oligosaccharide can form a film and/or bond the fibers together when the treated fabric is pressed by a hot iron. Such a film will have adhesive strength, cohesive breaking strength, and cohesive breaking strain.

Nonlimiting examples for natural polymers are Isomaltose Oligosaccharide and their derivatives, and chitins and their derivatives.

The synthetic polymers useful in the present invention are comprised of monomers. Some nonlimiting examples of monomers which can be used to form the synthetic polymers of the present invention include: low molecular weight $C_1$–$C_6$ unsaturated organic mono-carboxylic and polycarboxylic acids, such as acrylic acid, methacrylic acid, crotonic acid, maleic acid and its half esters, itaconic acid, and mixtures thereof; esters of said acids with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; aromatic vinyl such as styrene, alpha-methylstyrene, t-butylstyrene, vinyl toluene, polystyrene macromer, and the like; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof. Preferably, said monomers are selected from the group consisting of vinyl alcohol; acrylic acid; methacrylic acid; methyl acrylate; ethyl acrylate; methyl methacrylate; t-butyl acrylate; t-butyl methacrylate; n-butyl acrylate; n-butyl methacrylate; isobutyl methacrylate; 2-ethylhexyl methacrylate; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof, and mixtures thereof.

Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C., most preferably, the adhesive polymer hereof, when dried to form a film will have a Tg of at least about 25° C., so that they are not unduly sticky, or "tacky" to the touch. Preferably said polymer is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which can be used as film-forming and/or adhesive polymers of the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); polyvinyl alcohol; polyvinylpyridine n-oxide; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly (vinylamine) hydrochloride; poly(vinyl alcohol-co-6% vinylamine); poly(vinyl alcohol-co-12% vinylamine); poly (vinyl alcohol-co-6% vinylamine hydrochloride); and poly (vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquaternary amine resins; poly(ethenylformamide); poly (vinylamine) hydrochloride; poly(vinyl alcohol-co-6% vinylamine); poly(vinyl alcohol-co-12% vinylamine); poly (vinyl alcohol-co-6% vinylamine hydrochloride); and poly (vinyl alcohol-co-12% vinylamine hydrochloride).

Preferred polymers useful in the present invention are selected from the group consisting of copolymers of hydrophilic monomers and hydrophobic monomers. The polymer can be linear random or block copolymers, and mixtures thereof.

Such hydrophobic/hydrophilic copolymers typically have a hydrophobic monomer/hydrophilic monomer ratio of from about 95:5 to about 20:80, preferably from about 90:10 to about 40:60, more preferably from about 80:20 to about 50:50 by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water-soluble. In this regard, "substantially water insoluble" shall refer to a material that is not soluble in distilled (or equivalent) water, at 25° C., at a concentration of about 0.2% by weight, and preferably not soluble at about 0.1% by weight (calculated on a water plus monomer or polymer weight basis). "Substantially water-soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophobic monomers are acrylic acid $C_1$–$C_{18}$ alkyl esters, such as methyl acrylate, ethyl acrylate, t-butyl acrylate; methacrylic $C_1$–$C_{18}$ alkyl esters, such as methyl methacrylate, 2-ethyl hexyl methacrylate, methoxy ethyl methacrylate; vinyl alcohol esters of carboxylic acids, such as, vinyl acetate, vinyl propionate, vinyl neodecanoate; aromatic vinyls, such as styrene, t-butyl styrene, vinyl toluene; vinyl ethers, such as methyl vinyl ether; vinyl chloride; vinylidene chloride; ethylene, propylene and other unsaturated hydrocarbons; and the like; and mixtures thereof. Some preferred hydrophobic monomers are methyl acrylate, methyl methacrylate, t-butyl acrylate, t-butyl methacrylate, n-butyl acrylate, n-butyl methacrylate, and mixtures thereof.

Nonlimiting examples of useful hydrophilic monomers are unsaturated organic mono-carboxylic and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Preferably, the shape retention copolymers contain hydrophobic monomers and hydrophilic monomers which comprise unsaturated organic mono-carboxylic and polycarboxylic acid monomers, such as acrylic acid, methacrylic acid, crotonic acid, maleic acid and its half esters, itaconic acid, and salts thereof, and mixtures thereof; and optionally other hydrophilic monomers. These preferred polymers of the current invention surprisingly provide control of certain amine type malodors in fabrics, in addition to providing the fabric wrinkle control benefit. Examples of the hydrophilic unsaturated organic mono-carboxylic and polycarboxylic acid monomers are acrylic acid, methacrylic acid, crotonic acid, maleic acid and its half esters, itaconic acid, and mixtures thereof. Nonlimiting examples of the hydrophobic monomers are esters of the unsaturated organic mono-carboxylic and polycarboxylic acids cited hereinabove with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, and mixtures thereof, preferably methanol, ethanol, 1-propanol, 2-propanol, 1-butanol, 2-methyl-1-propanol, t-butanol, and mixtures thereof. Compositions containing these polymers also can additionally comprise perfume, antibacterial active, odor control agent, static control agent, and mixtures thereof.

It is not intended to exclude the use of higher or lower levels of the polymers, as long as an effective amount is used to provide adhesive and film-forming properties to the composition and the composition can be formulated and effectively applied for its intended purpose.

Highly preferred adhesive and/or film forming polymers that are useful in the composition of the present invention actually contain silicone moieties in the polymers themselves. These preferred polymers include graft and block copolymers of silicone with moieties containing hydrophilic and/or hydrophobic monomers described hereinbefore. The silicone-containing copolymers in the composition of the present invention provide shape retention, body, and/or good, soft fabric feel.

Both silicone-containing graft and block copolymers useful in the present invention have the following properties:

(1) the silicone portion is covalently attached to the non-silicone portion;

(2) the molecular weight of the silicone portion is from about 1,000 to about 50,000; and (3) the non-silicone portion must render the entire copolymer soluble or dispersible in the wrinkle control composition vehicle and permit the copolymer to deposit on/adhere to the treated fabrics.

Suitable silicone copolymers include the following:

Preferred silicone-containing polymers are the silicone graft copolymers comprising acrylate groups described, along with methods of making them, in U.S. Pat. No. 5,658,557, Bolich et al., issued Aug. 19, 1997, U.S. Pat. No. 4,693,935, Mazurek, issued Sep. 15, 1987, and U.S. Pat. No. 4,728,571, Clemens et al., issued Mar. 1, 1988. Additional silicone-containing polymers are disclosed in U.S. Pat. No. 5,480,634, Hayama et al, issued Oct. 2, 1996, U.S. Pat. No. 5,166,276, Hayama et al., issued Nov. 24, 1992, U.S. Pat. No. 5,061,481, issued Oct. 29, 1991, Suzuki et al., U.S. Pat. No. 5,106,609, Bolich et al., issued Apr. 21, 1992, U.S. Pat. No. 5,100,658, Bolich et al., issued Mar. 31, 1992, U.S. Pat. No. 5,100,657, Ansher-Jackson, et al., issued Mar. 31, 1992, U.S. Pat. No. 5,104,646, Bolich et al., issued Apr. 14, 1992, all of which are incorporated herein by reference.

These polymers preferably include copolymers having a vinyl polymeric backbone having grafted onto it monovalent siloxane polymeric moieties, and components consisting of non-silicone hydrophilic and hydrophobic monomers.

The silicone-containing monomers are exemplified by the general formula:

$$X(Y)_n\ Si(R)_{3-m}Z_m$$

wherein X is a polymerizable group, such as a vinyl group, which is part of the backbone of the polymer; Y is a divalent linking group; R is a hydrogen, hydroxyl, lower alkyl (e.g. $C_1$–$C_4$), aryl, alkaryl, alkoxy, or alkylamino; Z is a monovalent polymeric siloxane moiety having an average molecular weight of at least about 500, is essentially unreactive under copolymerization conditions, and is pendant from the vinyl polymeric backbone described above; n is 0 or 1; and m is an integer from 1 to 3.

The preferred silicone-containing monomer has a weight average molecular weight of from about 1,000 to about 50,000, preferably from about 3,000 to about 40,000, most preferably from about 5,000 to about 20,000.

Nonlimiting examples of preferred silicone-containing monomers have the following formulae:

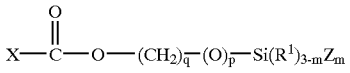

$$X{-}Si(R^1)_{3-m}Z_m$$

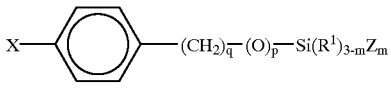

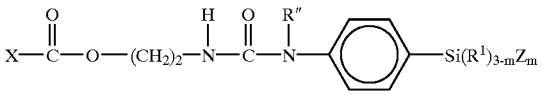

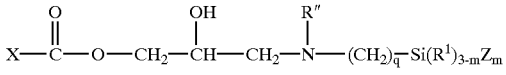

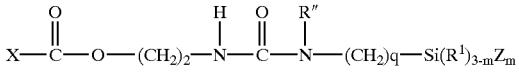

In these structures m is an integer from 1 to 3, preferably 1; p is 0 or 1; q is an integer from 2 to 6; n is an integer from 0 to 4, preferably 0 or 1, more preferably 0; $R^1$ is hydrogen, lower alkyl, alkoxy, hydroxyl, aryl, alkylamino, preferably $R^1$ is alkyl; R" is alkyl or hydrogen; X is $$CH(R^3){=}{=}C(R^4){-}$$

$R^3$ is hydrogen or —COOH, preferably hydrogen; $R^4$ is hydrogen, methyl or —$CH_2$COOH, preferably methyl; Z is $$R^5{-}[Si(R^6)(R^7){-}O{-}]_r$$

wherein $R^5$, $R^6$, and $R^7$, independently are lower alkyl, alkoxy, alkylamino, hydrogen or hydroxyl, preferably alkyl; and r is an integer of from about 5 to about 700, preferably from about 60 to about 400, more preferably from about 100 to about 300. Most preferably, $R^5$, $R^6$, and $R^7$ are methyl, p=0, and q=3.

Silicone-containing adhesive and/or film-forming copolymers useful in the present invention comprise from 0% to about 90%, preferably from about 10% to about 80%, more preferably from about 40% to about 75% of hydrophobic monomer, from about 0% to about 90%, preferably from about 5% to about 80% of hydrophilic monomer, and from about 5% to about 50%, preferably from about 10% to about 40%, more preferably from about 15% to about 25% of silicone-containing monomer.

The composition of any particular copolymer will help determine its formulation properties. In fact, by appropriate selection and combination of particular hydrophobic, hydrophilic and silicone-containing components, the copolymer can be optimized for inclusion in specific vehicles. For example, polymers which are soluble in an aqueous formulation preferably contain from 0% to about 70%, preferably from about 5% to about 70% of hydrophobic monomer, and from about 30% to about 98%, preferably from about 30% to about 80%, of hydrophilic monomer, and from about 1% to about 40% of silicone-containing monomer. Polymers which are dispersible preferably contain from 0% to about 70%, more preferably from about 5% to about 70%, of hydrophobic monomer, and from about 20% to about 80%, more preferably from about 20% to about 60%, of hydrophilic monomer, and from about 1% to about 40% of silicone-containing monomer.

The silicone-containing copolymers preferably have a weight average molecular weight of from about 10,000 to about 1,000,000, preferably from about 30,000 to about 300,000.

The preferred polymers comprise a vinyl polymeric backbone, preferably having a Tg or a Tm as defined above of about −20° C. and, grafted to the backbone, a polydimethylsiloxane macromer having a weight average molecular weight of from about 1,000 to about 50,000, preferably from about 5,000 to about 40,000, most preferably from about 7,000 to about 20,000. The polymer is such that when it is formulated into the finished composition, and then dried, the polymer phase separates into a discontinuous phase which includes the polydimethylsiloxane macromer and a continuous phase which includes the backbone. Exemplary silicone grafted polymers for use in the present invention include the following, where the composition of the copolymer is given with the approximate weight percentage of each monomer used in the polymerization reaction to prepare the copolymer: N,N-dimethylacrylamide/isobutyl methacrylate/(PDMS macromer—20,000 approximate molecular weight) (20/60/20 w/w/w), copolymer of average molecular weight of about 400,000; N,N-dimethylacrylamide/(PDMS macromer—20,000 approximate molecular weight) (80/20 w/w), copolymer of average molecular weight of about 300,000; and t-butylacrylate/N,N-dimethylacrylamide/

(PDMS macromer—10,000 approximate molecular weight) (70/10/20), copolymer of average molecular weight of about 400,000.

Highly preferred shape retention copolymers of this type contain hydrophobic monomers, silicone-containing monomers and hydrophilic monomers which comprise unsaturated organic mono- and polycarboxylic acid monomers, such as acrylic acid, methacrylic acid, crotonic acid, maleic acid and its half esters, itaconic acid, and salts thereof, and mixtures thereof. These preferred polymers surprisingly provide control of certain amine type malodors in fabrics, in addition to providing the fabric wrinkle control benefit. A nonlimiting example of such copolymer is n-butylmethacrylate/acrylic acid/(polydimethylsiloxane macromer, 20,000 approximate molecular weight) copolymer of average molecular weight of about 100,000, and with an approximate monomer weight ratio of about 70/10/20. A highly preferred copolymer is composed of acrylic acid, t-butyl acrylate and silicone-containing monomeric units, preferably with from about 20% to about 90%, preferably from about 30% to about 80%, more preferably from about 50% to about 75% t-butyl acrylate; from about 5% to about 60%, preferably from about 8% to about 45%, more preferably from about 10% to about 30% of acrylic acid; and from about 5% to about 50%, preferably from about 10% to about 40%, more preferably from about 15% to about 30% of polydimethylsiloxane of an average molecular weight of from about 1,000 to about 50,000, preferably from about 5,000 to about 40,000, most preferably from about 7,000 to about 20,000. Nonlimiting examples of acrylic acid/tert-butyl acrylate/polydimethyl siloxane macromer copolymers useful in the present invention, with approximate monomer weight ratio, are: t-butylacrylate/acrylic acid/(polydimethylsiloxane macromer, 10,000 approximate molecular weight) (70/10/20 w/w/w), copolymer of average molecular weight of about 300,000; t-butyl acrylate/acrylic acid/(polydimethylsiloxane macromer, 10,000 approximate molecular weight) (63/20/17), copolymer of average molecular weight of from about 120,000 to about 150,000; and n-butylmethacrylate/acrylic acid/(polydimethylsiloxane macromer—20,000 approximate molecular weight) (70/10/20 w/w/w), copolymer of average molecular weight of about 100,000. A useful and commercially available copolymer of this type is Diahold® ME from Mitsubishi Chemical Corp., which is a t-butyl acrylate/acrylic acid/(polydimethylsiloxane macromer, 12,000 approximate molecular weight) (60/20/20), copolymer of average molecular weight of about 128,000.

Silicone Block Copolymers

Also useful herein are silicone block copolymers comprising repeating block units of polysiloxanes.

Examples of silicone-containing block copolymers are found in U.S. Pat. No. 5,523,365, to Geck et al., issued Jun. 4, 1996; U.S. Pat. No. 4,689,289, to Crivello, issued Aug. 25, 1987; U.S. Pat. No. 4,584,356, to Crivello, issued Apr. 22, 1986; Macromolecular Design, Concept & Practice, Ed: M. K. Mishra, Polymer Frontiers International, Inc., Hopewell Jct., NY (1994), and Block Copolymers, A. Noshay and J. E. McGrath, Academic Press, NY (1977), which are all incorporated by reference herein in their entirety. Other silicone block copolymers suitable for use herein are those described, along with methods of making them, in the above referenced and incorporated U.S. Pat. No. 5,658,577.

The silicone-containing block copolymers useful in the present invention can be described by the formulae A—B, A—B—A, and —(A—B)$_n$— wherein n is an integer of 2 or greater. A—B represents a diblock structure, A—B—A represents a triblock structure, and —(A—B)$_n$— represents a multiblock structure. The block copolymers can comprise mixtures of diblocks, triblocks, and higher multiblock combinations as well as small amounts of homopolymers.

The silicone block portion, B, can be represented by the following polymeric structure $$—(SiR_2O)_m—$$

wherein each R is independently selected from the group consisting of hydrogen, hydroxyl, $C_1$–$C_6$ alkyl, $C_1$–$C_6$ alkoxy, $C_2$–$C_6$ alkylamino, styryl, phenyl, $C_1$–$C_6$ alkyl or alkoxy-substituted phenyl, preferably methyl; and m is an integer of about 10 or greater, preferably of about 40 or greater, more preferably of about 60 or greater, and most preferably of about 100 or greater.

The non-silicone block, A, comprises monomers selected from the monomers as described hereinabove in reference to the non-silicone hydrophilic and hydrophobic monomers for the silicone grafted copolymers. Vinyl blocks are preferred co-monomers. The block copolymers preferably contain one or more non-silicone blocks, and up to about 50%, preferably from about 10% to about 20%, by weight of one or more polydimethyl siloxane blocks.

Also useful herein are sulfur-linked silicone containing copolymers, including block copolymers. As used herein in reference to silicone containing copolymers, the term "sulfur-linked" means that the copolymer contains a sulfur linkage (i.e., —S—), a disulfide linkage (i.e., —S—S—), or a sulfhydryl group (i.e., —SH).

These sulfur-linked silicone-containing copolymers are represented by the following general formula:

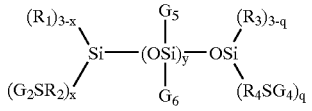

wherein each $G_5$ and $G_6$ is independently selected from the group consisting of alkyl, aryl, alkaryl, alkoxy, alkylamino, fluoroalkyl, hydrogen, and —ZSA, wherein A represents a vinyl polymeric segment consisting essentially of polymerized free radically polymerizable monomer, and Z is a divalent linking group (Useful divalent linking groups Z include but are not limited to the following: $C_1$ to $C_{10}$ alkylene, alkarylene, arylene, and alkoxyalkylene. Preferably, Z is selected from the group consisting of methylene and propylene for reasons of commercial availability.);

each $G_2$ comprises A;

each $G_4$ comprises A;

each $R_1$ is a monovalent moiety selected from the group consisting of alkyl, aryl, alkaryl, alkoxy, alkylamino, fluoroalkyl, hydrogen, and hydroxyl (Preferably, $R_1$ represents monovalent moieties which can independently be the same or different selected from the group consisting of $C_{1-4}$ alkyl and hydroxyl for reasons of commercial availability. Most preferably, $R_1$ is methyl.);

each $R_2$ is a divalent linking group (Suitable divalent linking groups include but are not limited to the following: $C_1$ to $C_{10}$ alkylene, arylene, alkarylene, and alkoxyalkylene. Preferably, $R_2$ is selected from the group consisting of $C_{1-3}$ alkylene and $C_7$–$C_{10}$ alkarylene due to ease of synthesis of the compound. Most preferably, $R_2$ is selected from the group consisting of —$CH_2$—, 1,3-propylene, and

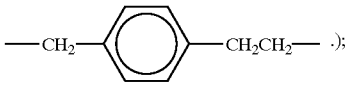

each $R_3$ represents monovalent moieties which can independently be the same or different and are selected from the group consisting of alkyl, aryl, alkaryl, alkoxy, alkylamino, fluoroalkyl, hydrogen, and hydroxyl (Preferably, $R_3$ represents monovalent moieties which can independently be the same or different selected from the group consisting of $C_{1-4}$ alkyl and hydroxyl for reasons of commercial availability. Most preferably, $R_3$ is methyl.);

each $R_4$ is a divalent linking group (Suitable divalent linking groups include but are not limited to the following: $C_1$ to $C_{10}$ alkylene, arylene, alkarylene, and alkoxyalkylene. Preferably, $R_4$ is selected from the group consisting of $C_{1-3}$ alkylene and $C_7$–$C_{10}$ alkarylene for ease of synthesis. Most preferably, $R_4$ is selected from the group consisting of —$CH_2$—, 1,3-propylene,

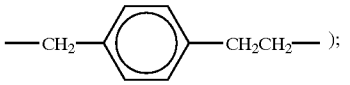

and x is an integer of 0–3;

y is an integer of 5 or greater(preferably y is an integer ranging from about 14 to about 700, preferably from about 20 to about 200); and q is an integer of 0–3;

wherein at least one of the following is true:

q is an integer of at least 1;

x is an integer of at least 1;

$G_5$ comprises at least one —ZSA moiety; or $G_6$ comprises at least one —ZSA moiety.

As noted above, A is a vinyl polymeric segment formed from polymerized free radically polymerizable monomers. The selection of A is typically based upon the intended uses of the composition, and the properties the copolymer must possess in order to accomplish its intended purpose. If A comprises a block in the case of block copolymers, a polymer having AB and/or ABA architecture will be obtained depending upon whether a mercapto functional group —SH is attached to one or both terminal silicon atoms of the mercapto functional silicone compounds, respectively. The weight ratio of vinyl polymer block or segment, to silicone segment of the copolymer can vary. The preferred copolymers are those wherein the weight ratio of vinyl polymer segment to silicone segment ranges from about 98:2 to 50:50, in order that the copolymer possesses properties inherent to each of the different polymeric segments while retaining the overall polymer's solubility.

Sulfur linked silicone copolymers are described in more detail in U.S. Pat. No. 5,468,477, to Kumar et al., issued Nov. 21, 1995, and PCT Application No. WO 95/03776, assigned to 3M, published Feb. 9, 1995, which are incorporated by reference herein in their entirety.

b)—Polymers Comprising at Least One Unit Which Provide a Dye Transfer Inhibiting Benefit The preferred polymers comprising at least one unit which provide a dye transfer inhibiting benefit are water-soluble polymers.

The polymers comprising at least one unit which provide a dye transfer inhibiting benefit useful in the present invention have the formula:

$$[—P(D)_m—]_n$$

wherein the unit P is a polymer backbone which comprises units which are homopolymeric or copolymeric. D units are defined herein below. For the purposes of the present invention the term "homopolymeric" is defined as "a polymer backbone which is comprised of units having the same unit composition, i.e., formed from polymerization of the same monomer". For the purposes of the present invention the term "copolymeric" is defined as "a polymer backbone which is comprised of units having a different unit composition, i.e., formed from the polymerization of two or more monomers".

P backbones preferably comprise units having the formula:

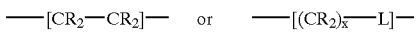

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

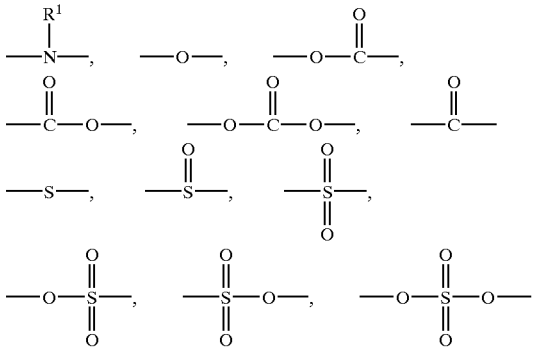

polysiloxane having the formula:

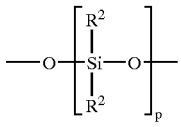

wherein the index p is from 1 to about 6; units which have dye transfer inhibition activity:

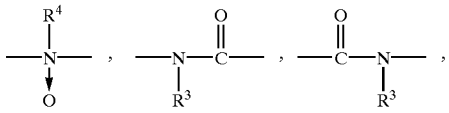

and mixtures thereof; wherein $R^1$ is hydrogen, $C_1$–$C_{12}$ alkyl, $C_6$–$C_{12}$ aryl, and mixtures thereof. $R^2$ is $C_1$–$C_{12}$ alkyl, $C_1$–$C_{12}$ alkoxy, $C_6$–$C_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the polymers of the present invention comprise one or more D units which are units which comprise one or more units which provide a dye transfer inhibiting benefit. The D unit can be part of the backbone itself as represented in the general formula:

$$[—P(D)_m—]_n$$

or the D unit may be incorporated into the backbone as a pendant group to a backbone unit having, for example, the formula:

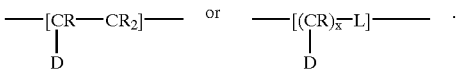

However, the number of D units depends upon the formulation. For example, the number of D units will be adjusted to provide water solubility of the polymer as well as efficacy of dye transfer inhibition. The molecular weight of the polymers of the present invention are from about 500, preferably from about 1,000, more preferably from about 10,000 most preferably from 200,000 to about 6,000,000, preferably to about 2,000,000, more preferably to about 1,000,000, yet more preferably to about 500,000, most preferably to about 360,000 daltons. Therefore the value of the index n is selected to provide the indicated molecular weight, and providing for a water solubility of at least 100 ppm, preferably at least about 300 ppm, and more preferably at least about 1,000 ppm in water at ambient temperature which is defined herein as 25° C.

Non-limiting examples of preferred D units are D units which comprise an amide moiety. Examples of polymers wherein an amide unit is introduced into the polymer via a pendant group includes polyvinylpyrrolidone having the formula:

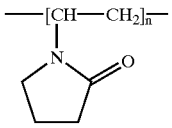

polyvinyloxazolidone having the formula:

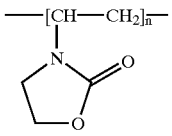

polyvinylmethyloxazolidone having the formula:

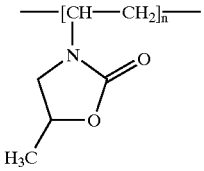

polyacrylamides and N-substituted polyacrylamides having the formula:

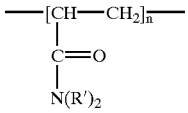

wherein each R' is independently hydrogen, $C_1$–$C_6$ alkyl, or both R' units can be taken together to form a ring comprising 4–6 carbon atoms; polymethacrylamides and N-substituted polymethacrylamides having the general formula:

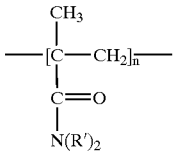

wherein each R' is independently hydrogen, $C_1$–$C_6$ alkyl, or both R' units can be taken together to form a ring comprising 4–6 carbon atoms; poly(N-acrylylglycinamide) having the formula:

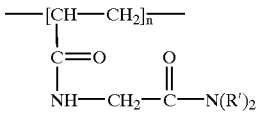

wherein each R' is independently hydrogen, $C_1$–$C_6$ alkyl, or both R' units can be taken together to form a ring comprising 4–6 carbon atoms; poly(N-methacrylylglycinamide) having the formula:

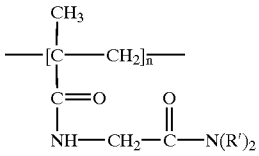

wherein each R' is independently hydrogen, $C_1$–$C_6$ alkyl, or both R' units can be taken together to form a ring comprising 4–6 carbon atoms; polyvinylurethanes having the formula:

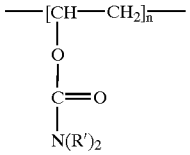

wherein each R' is independently hydrogen, $C_1$–$C_6$ alkyl, or both R' units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

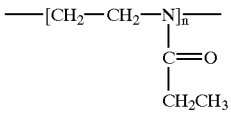

wherein the index n indicates the number of monomer residues present.

The amino-functional polymers of the present invention can comprise any mixture of dye transfer inhibition units which provides the product with suitable properties.

The preferred polymers which comprise D units which are amide moieties are those which have the nitrogen atoms of the amide unit highly substituted so the nitrogen atoms are in effect shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamides. A detailed description of physico-chemical properties of some of these polymers are given in "Water-Soluble Synthetic Polymers: Properties and Behavior", Philip Molyneux, Vol. I, CRC Press, (1983) included herein by reference.

The amide containing polymers may be present partially hydrolyzed and/or crosslinked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups, in the backbone and/or the ring, conferring hydrophobic properties. PVP is readily soluble in aqueous and organic solvent systems. PVP is available ex ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as shown below:

| PVP viscosity average molecular weight (in thousands of daltons) | | | | | |
|---|---|---|---|---|---|
| K-12 | K-15 | K-25 | K-30 | K-60 | K-90 |
| 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3MM, commercially available ex Aldrich is also suitable for use herein. Yet further PVP-type of material suitable for use in the present invention are polyvinylpyrrolidone-co-dimethylaminoethylmethacrylate, commercially available ex ISP in a quaternised form under the tradename Gafquat® or commercially available ex Aldrich Chemical Co. having a molecular weight of approximately 1.0MM; copolymer of 3-methyl-1-vinyl-1H-imidazolium chloride and 1-vinyl-2-pyrrolidone (30:70) ex BASF under the tradename Luviquat FC370, polyvinylpyrrolidone-co-vinyl acetate, available ex BASF under the tradename Luviskol®, available in vinylpyrrolidone:vinylacetate ratios of from 3:7 to 7:3; polyvinylpyrrolidine-co-vinylimidazoliumquat, commercially available ex BASF under the tradename Luviquat®.

Another D unit which provides dye transfer inhibition enhancement to the polymers described herein, are N-oxide units having the formula:

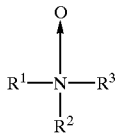

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyriding N-oxide, PVNO). In addition, the N-oxide unit may be pendant to the ring, for example, aniline oxide.

N-oxide comprising polymers of the present invention will preferably have a ratio of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine N-oxides of the present invention have a $Pk_a$ less than or equal to 10, preferably less than or equal to 7, more preferably less than or equal to 6. The average molecular weight of the N-oxide comprising polymers which provide a dye transfer inhibitor benefit to polymers is from about 500 daltons, preferably from about 10,000 daltons, more preferably from about 20,000 daltons to about 6,000,000 daltons, preferably to about 2,000,000 daltons, more preferably to about 360,000 daltons.

A further example of polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

c)—Urethanes Polymers

Polymers of the urethane type are also suitable components for use herein. A typical disclosure of polyurethane polymer can be found in EP844274A1 as well as in EP839903.

d)—Isomaltooligosaccharide

Isomaltooligosaccharides (IMO) (including mixtures), the individual components of said mixtures, substituted versions thereof, derivatised versions thereof, and mixtures thereof are suitable components for use herein. Currently IMO is used as corn syrup. These components are particularly suitable where cellulosic fibers/fabrics are used, such as cotton, rayon, ramie, jute, flax, linen, polynosic-fibers, Lyocell (Tencel®), polyester/cotton blends, other cotton blends, and the like, especially cotton, rayon, linen, polyester/cotton blends, and mixtures thereof.

Suitable fabric improving actives that are useful in the present invention include oligosaccharides with a degree of polymerization (DP) of from about 1 to about 15, preferably from about 2 to about 10, and wherein each monomer is selected from the group consisting of reducing saccharide containing 5 and/or 6 carbon atoms, including isomaltose, isomallotriose, isomaltotetraose, isomaltooligosaccharide, fructooligosaccharide, levooligosaccharides, galactooligosaccharide, xylooligosaccharide, gentiooligosaccharides, disaccharides, glucose, fructose, galactose, xylose, mannose, arabinose, rhamnose, maltose, sucrose, lactose, maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosaccharides from partial hydrolysates of natural polysaccharide sources, and the like, and mixtures thereof, preferably mixtures of isomaltooligosaccharides, especially mixtures including isomaltooligosaccharides, comprising from about 3 to about 7 units of glucose, respectively, and which are linked by 1,2-α, 1,3-α, 1,4-α- and 1,6-α-linkages, and mixtures of these linkages. Oligosaccharides containing b-linkages are also preferred. Preferred oligosaccharides are acyclic and have at least one linkage that is not an α-1,4-glycosidic bond. A preferred oligosaccharide is a mixture containing IMO: from 0 to about 20% by weight of glucose, from about 10 to about 65% of isomaltose, from about 1% to about 45% of each of isomaltotriose, isomaltetraose and isomaltopentaose, from 0 to about 3% of each of isomaltohexaose, isomaltoheptaose, isomaltooctaose and isomaltononaose, from about 0.2% to about 15% of each of isomaltohexaose and isomaltoheptaose, and from 0 to about 50% by weight of said mixture being isomaltooligosaccharides of 2 to 7 glucose units and from 0 to about 10% by weight of said mixture being isomaltooligosaccharides of about 7 to about 10 glucose units. Other nonlimiting examples of preferred acyclic oligosaccharides, with approximate content by weight percent, are:

| | |
|---|---|
| **Isomaltooligosaccharide Mixture I** | |
| Trisaccharides (maltotriose, panose, isomaltotriose) | 40–65% |
| Disaccharides (maltose, isomaltose) | 5–15% |
| Monosaccharide (glucose) | 0–20% |
| Higher branched sugars (4 < DP < 10) | 10–30% |
| **Isomaltooligosaccharide Mixture II** | |
| Trisaccharides (maltotriose, panose, isomaltotriose) | 10–25% |
| Disaccharides (maltose, isomaltose) | 10–55% |
| Monosaccharide (glucose) | 10–20% |
| Higher branched sugars (4 < DP < 10) | 5–10% |
| **Isomaltooligosaccharide Mixture III** | |
| Tetrasaccharides (stachyose) | 10–40% |
| Trisaccharides (raffinose) | 0–10% |
| Disaccharides (sucrose, trehalose) | 10–50% |
| Monosaccharide (glucose, fructose) | 0–10% |
| Other higher branched sugars (4 < DP < 10) | 0–5% |

Oligosaccharide mixtures are either prepared by enzymatic reactions or separated as natural products from plant materials. The enzymatic synthesis of oligosaccharides involves either adding monosaccharides, one at a time, to a di- or higher saccharide to produce branched oligosaccharides, or it can involve the degradation of polysaccharides followed by transfer of saccharides to branching positions. For instance, Oligosaccharide Mixtures I and II are prepared by enzymatic hydrolysis of starch to maltooligosaccharides, which are then converted to isomaltooligosaccharides by a transglucosidase reaction. Oligosaccharide Mixture III, for example, is a mixture of oligosaccharides isolated from soybean. Soybean oligosaccharides such as Mixture III, are of pure natural origin.

Substituted and/or derivatised materials of the oligosaccharides listed hereinabove are also suitable in the present invention. Nonlimiting examples of these materials include: carboxyl and hydroxymethyl substitutions (e.g., glucuronic acid instead of glucose); amino oligosaccharides (amine substitution, e.g., glucosamine instead of glucose); cationic quaternized oligosaccharides; $C_1$–$C_6$ alkylated oligosaccharides; acetylated oligosaccharide ethers; oligosaccharides having amino acid residues attached (small fragments of glycoprotein); oligosaccharides containing silicone moieties. These substituted and/or derivatised oligosaccharides can provide additional benefits, such as: carboxyl and hydroxymethyl substitutions can introduce readily oxidizable materials on and in the fiber, thus reducing the probability of the fiber itself being oxidized by oxidants, such as bleaches; amine substitution can bind and/or condense with oxidatively damaged regions of the fiber to rejuvenate aged fabrics; acetylated sugar ethers can serve as bleach activators in subsequent processes where hydrogen peroxide is present; oligosaccharides having amino acid residues can improve delivery of fabric care benefits for fabrics containing proteinaceous fibers, e.g., wool and silk; and silicone-derivatised oligosaccharides can provide additional fabric softness and lubricity. $C_6$ alkyl oligosaccharide is disclosed (along with other higher, viz., $C_6$–$C_{30}$, alkyl polysaccharides) in U.S. Pat. No. 4,565,647. Typical disclosure of $C_1$–$C_6$ alkylated oligosaccharides can also be found in U.S. Pat. No. 4,488,981. These patents are incorporated herein by reference.

One preferred isomaltooligosaccharide is IMO 900 commercially available from Showa Sangyo Co.)

e)—Polyvinylamines Polymers

Polyvinylamines polymers are also suitable component giving a deviation of fabric WRA of at least 15. Typical polyvinylamines polymers include the the quaternized and non-quaternized polyvinylamines having the formula:

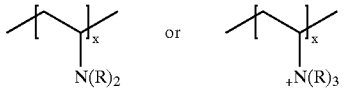

wherein R is hydrogen, C1–C12 linear or branched alkyl, benzyl, or alkyleneoxy having the formula (R1O)zY, wherein R1 is C1–C6 linear or branched alkylene, Y is hydrogen or an anionic unit, non-limiting examples of which include, —(CH2)fCO2M, —C(O)(CH2)fCO2M, —(CH2)fPO3M, —(CH2)fOPO3M, —(CH2)fSO3M, —CH2(CHSO3M)—(CH2)fSO3M, —CH2(CHSO2M)(CH2)fSO3M, —C(O)CH2CH(SO3M)CO2M, —C(O)CH2CH(CO2M)NHCH(CO2M)CH2CO2M, —C(O)CH2CH(CO2M)NHCH2CO2M, —CH2CH(OZ)CH2O(R1O)tZ, —(CH2)fCH[O(R2O)tZ]CH2O(R2O)tZ, and mixtures thereof, wherein Z is hydrogen or an anionic unit non-limiting examples of which include —(CH2)fCO2M, —C(O)(CH2)fCO2M, —(CH2)fPO3M, —(CH2)fO PO3M, —(CH2)fSO3M, —CH2(CHSO3M)—(CH2)fSO3M, —CH2(CHSO2M)(CH2)fSO3M, —C(O)CH2CH(SO3M)

CO2M, —C(O)CH2CH(CO2M)NHCH(CO2M)CH2CO2M, and mixtures thereof, M is a cation which provides charge neutrality; and the index f is from 0 to 6, t is 0 or 1, z is from 1 to 50.

The index x has the value from about 50 to about 1,500; preferably the index x has a value such that the resulting polymeric suds stabilizer has an average molecular weight of from about 2,500, preferably from about 10,000, more preferably from about 20,000 to about 150,000, preferably to about 90,000, more preferably to about 80,000 daltons.

Most preferred polymers for use in the present invention are water-soluble, including IMO 900 (Isomaltose Oligosaccharide ex. Show a Sangyo Co.), Avalure AC 120 (Polyacrylate ex. BF Goodrich), Luviskol K30, K60 and K85 (Polyvinylpyrrolidone MW 40.000, 400.000 and 1.250.000 ex. BASF), Luvitec VPC 55K65W (copolymer Vinylpyrrolidone & Vinylcaprolactam ex. BASF), Luvitec Quat 73W (copolymer 1-methyl-3-vinyl-imidazolium-methylsulfate & 1-vinyl-2-pyrrolidone ex. BASF), Luviquat FC 905 (copolymer Vinylimidazolium methochloride & Vinylpyrrolidone ex. BASF), Sedipur 520 (modified Polyacrylamide ex. BASF), Chitanide 222 (Chitosan succinamide ex. MIP), Mirasil ADM-E (Aminodimethicone ex. Rhone-Poullanc), Percol 370 (diallyl amine polymer ex. CIBA), Amphomer HC (Acrylate/Octylacrylamide copolymer ex. National Starch), and mixtures thereof.

f)—Amphoteric Polymers

Suitable for use herein are amphoteric polymers, i.e., polymers comprising at least one anionic moiety and one cationic moieity, and optionally a non-ionic moiety. The anionic moiety comprises a group which is a deprotonated anion of an acid group when the polymer is dissolved/dispersed in water at a pH of about 7 and which can be protonated to form a nonionic acid group when the polymer is dissolved/dispersed in water at an acidic pH. Representative examples of such groups include carboxylate, phosphonate, phosphate, phosphate, sulfonate, sulfate groups, and combinations thereof.

Optionally, each moiety may be further complexed with a separate, cationic counterion other than hydrogen. When used, representative examples of such counterions, include $Na^+$, $Li^+$, $K^+$, $NH4^+$ or combinations thereof.

The cationic moiety comprises a protonated cation when the polymer is dissolved/dispersed in water at a pH of about 7 or below and can be deprotonated to a nonionic form when the polymer is dissolved/dispersed in water at a basic pH. Alternatively, the cationic moiety comprises a group which is a quaternized group.

Representative examples of the protonated group include the ammonium functionality, phosphonium functionality, sulfonium functionality, and combinations thereof. The term ammonium refers to a moiety including a nitrogen atom linked to a plurality of moieties (either H, alkyl or aryl groups) by four bonds when dissolved/dispersed in water at a pH of 7. The term sulfonium refers to a moiety including a sulfur atom linked to three other moieties (either H, alkyl or aryl groups) when dispersed in water at a pH of about 7. The term phosphonium refers to a moiety including a phosphorous atom linked to four other moieties (either H, alkyl or aryl groups) when dispersed in water at a pH of about 7.

Examples of the ammonium, phosphonium and sulphonium functionality may be presented by the following formulae, respectively:

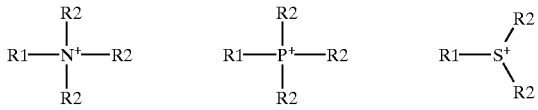

In these formulae, R1 represents the polymer backbone and R2 represents hydrogen, alkyl or aryl substituents. In case the cationic moiety exists as a quaternized group, all R2 groups represents alkyl or aryl substituents, excluding hydrogen.

As an option, each such second functional group may be further complexed with a separate, anionic counterion. When used, representative examples of such counterion, include chlorides, sulfates, carbonates, nitrates, formiates, perchlorates, or combinations thereof.

Optionally, amphoteric polymers herein comprise a non-ionic moiety. A preferred class of amphoteric polymers for use herein are polymers composed of both cationic and anionic vinylmonomers.

Suitable anionic vinylmonomers for use herein include salts of acrylic acid, methacrylic acid, crotonic acid, maleic acid, fumaric acid, itaconic acid and vinylsulphonic acid. Suitable cationic vinylmonomers for use herein include salts of unsaturated amines such as the hydrochloride salt of vinylamine, salts of N,N'-dialkylaminoalkyl (meth) acrylates and N,N'-dialkyliminoalkyl (meth) acrylamides such as the hydrochloride salt of dimethylaminoethylmethacrylate (DMAEMA.HCl) or dimethylaminopropylacrylamide; alkyl quaternized aminoalkyl (meth) acrylates and aminoalky (meth) acrylamides such as trimethylammoniumethyl methacrylatechloride, trimethylammoniumpropyl acrylamidemethylsulfate, alkyl quaternized polar vinyl heterocyclics such as based on pyridinium or imidazolium such as alkylvinylpyridinium, alkylvinylimidazolium and mixtures thereof.

Optionally, a non-ionic comonomer can be incorporated, such as amides and imides of organic acids, such as acrylamide, N,N-dialkylacrylamide, N-t-butylacrylamide, maleimides, vinylformamide, aromatic vinyl monomers such as styrene, vinyltoluene, t-butylstyrene; polar vinyl heterocyclics such as vinyl pyrrolidone, vinyl caprolactam, vinyl pyridine, vinylimidazole; low molecular weight unsaturated hydrocarbons and derivatives such as ethylene, propylene, butadiene, cyclohexadiene, vinylchloride and mixtures thereof.

A preferred polymer of this class is based on poly (vinylamine-co-acrylic acid), in molar ratios varying between 1:100 to 100:1, preferably 90:10 to 40:60. Polymers of this class preferably have a molecular weight between 20.000 and 5.000.000 preferably between 30.000 and 1.000.000, more preferably between 50.000 and 300.000.

A second class of polymers which are preferred for use herein are anionically modified polyethyleneimines. Examples of anionically modified polyethyleneimines include polyethyleneimines grafted with acrylic acid, methacrylic acid, maleic acid, fumaric acid, crotonic acid, itaconic acid, or carboxymethylated.

The processes for the preparation of anionically modified polyethyleneimines are well known. They can be prepared by reacting α,β-unsaturated carboxylic acids (C=C—COOH) like acrylic or maleic acid with polyethyleneimine (Michael-type reaction) or by carboxymethylation. The carboxymethylation is carried out by reacting polyethyleneimine either with chloroacetic acid or with formaldehyde and sodium cyanide and subsequent saponification of the resultant aminonitrile. The latter procedure is well-known as the "Strecker Synthesis".

Polymers of this class have a degree of substitution of between 5 and 95, preferably 20 and 80, and a molecular weight between 5000 and 2 000 000, preferably 20 000 and 1 000 000.

In the present invention, the amphoteric polymers can be provided to the clothes in amounts of from $1\times10^{-7}$ g/g fabric to 0.3 g/g fabric, preferably from $1\times10^{-5}$ g/g fabric to 0.1 g/g fabric; more preferably from $1\times10^{-3}$ g/g fabric to $1\times10^{-2}$ g/g fabric.

g)—Curable Silicones

Also suitable for use herein are curable silicones. "Curable" silicone molecules have the ability to reach one with each other to yield a polymeric elastomer of a much higher molecular weight compared to the original molecule. Thus, "curing" often occurs when two curable silicone molecules or curable silicone polymers react yielding a polymer of a higher molecular weight. This "cure" reaction is define herein as the formation of new silicon-oxygen, silicon-carbon, and/or carbon-carbon linkages. Curable silicones can be cross-linked to some degree before application. That means that the curable) silicone has cured to some degree before application but that can still further cure during and after application. Cross-linked curable silicones are preferred.

Examples of curable silicones are vinyl-, allyl-, silane-, epoxy-, alkoxy-, and/or silanol-modified polydimethylsiloxanes, and mixtures thereof. Some curable silicones may required the cooperative use of a catalyst to induce curing, as in the case of vinyl-,hydrogen-modified silicones which cure via a hydrosilation process catalyzed by platinum compounds or radical catalysts. More preferred in this invention are curable silicone able to cure without the addition of a catalysts, such as epoxy-, alkoxy-, and/or silanol-modified polydimethylsiloxanes. Most preferred are silanol-stopped polydimethyl-siloxanes emulsions.

Curable silicones can have other organic group modifications as for example, although not restricting, amino or polyalkyleneoxide groups. Curable silicones may content reinforcing fillers. By reinforcing fillers we mean small particles made of inorganic or organic materials added to the curable silicone as additives or intimately linked to silicone molecules via covalent bonds. One example, although not restricting, are silica particles sized from 10 to 100 nanometers present in 10% to 100% by weight based on the weight of the silicone.

It is preferred that curable silicones are formulated as oil-in-water emulsions. Curable silicone emulsions are commercially available; e.g., GE-Bayer SM2112 Silicone Emulsions or Dow Corning Syl-Off® 7922 Catalyst Emulsion.

It is believed that curable silicones cure during or/and after application to the fabrics producing a network which will prevent the formation of wrinkles.

Other suitable film-forming polymers for use herein are durable press polymers. Durable press polymers are optional components of the invention. These polymers can be a cross-linking resin having the property of being cationic. By "cross-linking resin having the property of being cationic", it is meant that the resin is at least partially positively charged. It is not however necessary that the reactive part of the molecule carries the positive charge. Indeed, polymeric resins can be based on positively charged monomers which help the deposition on the fibers.

Cross-linking resins having the property of being cationic suitable for use herein are those commonly known as having wet strength in the paper field. At least two mechanisms have been postulated to account for the mechanism by which wet strength resin act. One is that wet strength resins form covalent bonds between adjacent fibers while another is that the wet strength resin places a layer over the hydrogen bonds formed between adjacent paper fibers and thus prevents water from breaking the hydrogen bonds.

Conventional wet-strength agents suitable for use herein include compounds made of epichlorohydrin adducts of polyamine resins, polyethyleneimine resins, cationic starch, polydiallyldimethylammonium chloride, and mixtures thereof, amine-aldehyde resins such as melamine-formaldehyde resin, amide-aldehyde resins, and mixtures thereof. For use within the meaning of the present invention, there can also be used materials of the above-mentioned classes of substances which admittedly do not themselves possess any outstanding wet-strength properties but, nevertheless, have the same durable press effect as do the wet-strength agents as described therein.

Among the class of epichlorohydrin adducts of polyamine resins, polyethyleneimine resins, cationic starch, polydiallyldimethylammonium chloride, and mixtures thereof, the preferred components are the polymeric amine-epichlorohydrin resins selected from the group consisting of a polyamide-epichlorohydrin (PAE) resin, a polyalkylenepolyamine-epichlorohydrin (PAPAE) resin, and an amine polymer-epichlorohydrin (APE) resin, in which the amine groups have been alkylated with epichlorohydrin to produce a polyamine-epichlorohydrin resin that has azetidinium or epoxide functionality. Preferably, for use herein, the cross-linking resin having cation c properties is a cationic wet strength resin that is produced by reacting a saturated aliphatic dicarboxylic acid containing three to ten carbon atoms with a polyalkylenepolyamine, containing from two to four ethylene groups, two primary amine groups, and one to three secondary amine groups (such as diethylenetriamine, triethylenetetramine and tetraethylenepentamine), to form a poly(aminoamide) having secondary amine groups that are alkylated with epichlorohydrin to form a PAE resin.

These polyamide/polyamine/epichlorohydrin wet-strength resins are fully described by Carr, Doane, Hamerstrand and Hofreiter, in an article appearing in the Journal of Applied Polymer Science Vol. 17, pp. 721–735 (1973). Such resins are available as KYMENE from Hercules, Inc. A commercial synthesis of such resins from adipic acid, diethylene triamine and epichlorohydrin is described in the Carr et al publication, ibid., and is U.S. Pat. No. 2,926,154 (Feb. 23, 1960) to G. I. Keim or U.S. Pat. No. 4,240,995. Reference can be made to these publications for further details regarding the preparation of polyamide/polyamine/epichlorohydrin resins.

Most preferred cross-linking resin having cationic properties from this class are the wet strength resin Kymene 557H (available from Hercules Incorporated), in which adipic acid is reacted with diethylenetriamine to form a poly(aminoamide) that is alkylated and crosslinked with epichlorohydrin to form a PAE resin. Still another preferred cross-linking resin having cationic properties made of epichlorohydrin are Luresin.RTM and Etadurin which both are polyamidoamine-epichlorohydrin resins.

Amine-aldehyde resins are suitable cross-linking resins for the present invention and are made by condensation of amine or amide monomers with aldehydes such as formaldehyde or glyoxal. Preferred amines are those having low molecular weight amines e.g. melamine or polymeric amines e.g. polydiallylamine, preferably quarternized. Preferred amides are those polymeric amides such as polyacrylamide. All these suitable amine/amide monomers can also be copolymerized with cationic monomers.

Among the class of amine-aldehyde cross-linking resin, preferred are those from the class of melamine-formaldehyde resin. Melamine-formaldehyde resins of this type are known as crosslinking agents of this type in the coating industry and are also described, for example, in German Auslegeschrift Nos. 2,457,387 (U.S. Pat. No. 4,035,213 incorporated herein by reference) and U.S. Pat. No. 1,719,324 and, in particular, in U.S. Pat. No. 3,242,230 incorporated herein by reference.

Preferred melamine-formaldehyde resin are those commercially available under the tradenames Madurit, and Cassurit from Clariart.

Still other preferred cross-linking resin having the property of being cationic among the class of amine-aldehyde cross-linking resin are the Poly(acrylamide-glyoxal) resin commercially available under the tradename SOLIDURIT KM from Clariant.

According to the present invention, there can also be used a mixture of wet-strength agents of the above-mentioned types or equivalent compounds. Preferably for the purpose of the invention, the cross-linking resin having cationic properties have a molecular weight between 200 and 1,000,000, preferably between 500 and 100,000, most preferably between 1000 and 25,000. Cross-linking resin having a low molecular weight are most preferred for use in the present invention as they are more water-soluble and have a better fiber penetration. By low molecular weight it is meant a molecular weight within the range of from 25 to 2000, preferably from 50 to 1000, and more preferably from 50to 500.

It is desirable if the level of cross-linking components or derivative thereof is present in an amount of from 0.01% to 60%, preferably from 0.01% to 30% by weight of the total composition It is advantageous for aldehyde containing cross-linking resins if a catalyst is used with compositions of the invention. Preferred catalysts includes organic acids such as citric acid, succinic acid, and tartaric acids, as well as conventional Lewis acid such as Al $Cl_3$ or $MgCl_2$, or salts thereof, or mixtures thereof. A typical example of catalyst is the catalyst NKD made of a mixture of salts and organic acid, and commercially available from Hoechst.

It is preferred if the level of catalyst is from 10% to 50%, preferably from 20 to 40% by weight of the cross-linking components of derivative thereof.

For other cross-linking resins like the Kymene, the use of a catalyst is not necessary.

II)—The Blowing Agent:

The specific blowing agents which were found to be suitable for use herein are selected from the group consisting of ammonium carbonate, ammonium bicarbonate, group 1 metal bicarbonates, and mixtures thereof.

In the process of the invention, the fabrics are first provided with a film-forming material and a blowing agent selected from the group consisting of ammonium carbonate, ammonium bicarbonate, group 1 metal bicarbonates, or mixtures thereof, then the fabrics are ironed. It is hypothesized that, during ironing, the heat from the iron soleplate causes the blowing agent to release small amounts of $CO_2$ as microscopic gas bubbles within the film-forming material deposited on the surface of the fabric. The emission of gas $CO_2$ is simultaneous to the film formation, hence a baking effect is achieved. It is hypothesized that this causes a more effective distribution of the film-forming material within fibers and yarns which improves the elasticity and flexibility of the film, hence of the fabric. As a result, the fabric is more able to resist the formation of wrinkles when dry.

The film-forming material and the blowing agent can be provided to the fabrics separately, but in order to ensure a homogeneous mixing of the material and the agent, it is highly preferred to use a composition, as described above, which will comprise both ingredients. Both ingredients or the composition can be provided to the fabrics in a variety of manners.

The ingredients or the composition can be provided in a "through the wash treatment", in a detergent composition, which will contain conventional detergency ingredients. The detergent can be a granular, solid, i.e. a block or a tablet, or a liquid. It is not necessary to describe here in detail suitable detergency ingredients, in particular detergent surfactants, and detergent compositions used in through the wash treatments have been described in EP 150 867 and EP 150 872. The description of detergent compositions in those two documents is incorporated herein by reference.

The ingredients or the composition can also be provided to the fabrics together with the last rinse in the laundering process. In this embodiment, both ingredients can be added to the rinse water as a standalone product, or they can be added to the rinse water as a component of a fabric conditioner. Fabric conditioners have been disclosed in WO 00/24853, WO/9201773 and EP 300 525. The description of fabric conditioners in those three documents is incorporated herein by reference.

Both ingredients, or the composition can also be provided to the clothes after the laundering process, when the clothes are wet, damp or dry. In this embodiment, the ingredients or the composition can be provided to the fabrics by a variety of means, such as brushing, spraying, or releasing from a substrate in an automatic clothes dryer. When sprayed, which is the preferred embodiment herein, the ingredients or the composition can be sprayed from a sprayer or an aerosol as a standalone product, or from an iron. When dispensed from an iron, the ingredients or the composition is either introduced in and dispensed from the iron's water tank as in EP 629 736, or from a separate reservoir in the iron as in U.S. Pat. No. 3,160,969, or by means of a cartridge to be inserted in the iron for the dispensing of its content as in WO99/27176.

It is a preferred embodiment that both ingredients be present in a single composition, and that the composition be sprayed onto the fabrics, and—before and/or during and/or after spraying, the fabrics be ironed. In other words, it is preferred that the ingredients be used together in an ironing product.

In all preferred embodiments, the ingredients are preferably formulated as an aqueous composition. The compositions herein thus preferably comprise 0.001% to 50%, more preferably from 0.01% to 10%, most preferably from 0.1% to 5% of a film-forming material, or mixtures thereof, and from 0.01% to about 100%, preferably from 0.1% to 50%, most preferably from 1% to 25% by weight based on the weight of the film-forming material of a blowing agent. The balance is other—optional—ingredients, and water.

The compositions herein can further comprise a variety of other—optional—ingredients, such as lubricants, surfactants, wetting agents, stabilizers, preservatives, perfume, and other optional components conventionally used in textile treatment compositions.

Lubricants are primarily added, but not exclusively, to provide fabrics with softness, hand and ease of iron gliding. Compositions preferably comprise 0.1% to 20%, more preferably from 0.5% to 10%, most preferably from 1% to 5% of lubricants. Lubricants are selected from the group of non-ionic silicone-based surfactants, fatty acid esters, ethoxylated fatty alcohols, fatty amine compounds, quaternary ammonium compounds, polyamides, and mixtures thereof. It is preferred water-borne lubricants, more preferred are amino-modified polydimethylsiloxane emulsions, water soluble polyalkylene oxide-modified polydimethylsiloxanes and both saturated or unsaturated diester quaternary ammonium compounds, and most preferred are 2,2,6,6-tetramethyl-4-piperidyl-modified polydimethylsiloxane emulsions.

Surfactants are primarily added, but not exclusively, to stabilize water-borne compositions avoiding solids flocculation and/or phase splitting. Compositions preferably comprise 0.01% to 10%, more preferably from 0.05% to 5%, most preferably from 0.1% to 2% of surfactants. Surfactants are selected from the group of single long-chain alkyl cationic surfactants, long-chain alkyl anionic surfactants, non-ionic surfactants, amide-oxides, fatty acids, and mixtures thereof.

Wetting agents are primarily added, but not exclusively, to enhance the penetrability of the compositions into the fabrics. Compositions preferably comprise 0.01% to 10%, more preferably from 0.05% to 5%, most preferably from 0.1% to 2% of wetting agents. Wetting agents are selected from the group of lubricants and surfactants mentioned above. More preferred are water soluble polyalkylene oxide-modified polydimethylsiloxanes.

Stabilizers are primarily added, but not exclusively, to enhance the chemical stability of the compositions. Compositions preferably comprise 0.0001% to 5%, more preferably from 0.001% to 1%, most preferably from 0.01% to 0.5% of stabilizers. Stabilizers are selected from the group of antioxidants, pH buffers, aldehydes-control agents, reductive agents, and mixtures thereof.

Preservatives are primarily added, but not exclusively, to inhibit and/or regulate microbial growth in order to increase the storage stability of the composition. Compositions preferably comprise 0.0001% to 0.5%, more preferably from 0.0002% to 0.2%, most preferably from 0.0003% to 0.1% by weight of preservative. It is preferable to use broad spectrum microbiocide, i.e., one that is effective on both bacteria (both gram positive and gram negative), fungi and yeast. Still other preferred preservatives are water soluble.

Perfumes are primarily added, but not exclusively, to enhance odor of the composition before and during ironing. Compositions preferably comprise 0% to 10%, more preferably from 0.1% to 5%, most preferably from 0.2% to 3% by weight of perfume.

Other optional ingredients conventionally used in textile treatment compositions are humectants, like diethylene glycol, and/or salts like lithium salts, colorants and dyes, optical brighteners, opacifiers, anti-shrinkage agents, color protection agent like dye fixing agent as described in EP 931133, enzymes, chelating agents, cyclodextrin as described in WO 98/56888, metallic salts to absorb amine and sulfur-containing compounds and selected from the group consisting of copper salts, zinc salts, and mixtures thereof, water-soluble polyionic polymers, e.g., water-soluble cationic polymer like polyamines, and water-soluble anionic polymers like polyacrylic acids, other antistatic agent, insect and/or moth repelling agents, anti-clogging agent, and the like; typical disclosure of which can be found in WO 98/56888. Still other suitable optional ingredients are ingredients which provide shield protection against stain like hydroxypropylcellulose as well as other cellulosic polymer like carboxymethylcellulose. The compositions are preferably free of any material that would soil or stain fabric, and are also substantially free of starch. Typically, there should be less than about 0.5%, by weight of the composition, preferably less than about 0.3%, more preferably less than about 0.1%, by weight of the composition, of starch and/or modified starch.

The present invention also encompasses articles of manufacture comprising the composition comprising the film-forming material, the blowing agent, and usage instructions to use the composition in a process where the composition is first provided to the fabrics, and the fabrics are then ironed. In the preferred embodiment where the composition is as an ironing product, the composition is preferably contained in a manual trigger sprayer container, or in an aerosol container, or in an iron. The container is labeled with instructions, or accompanied with a leaflet bearing instructions to use the composition during the ironing process.

EXAMPLES

The invention is illustrated by the following examples.

Example 1

Spray-on Composition

| | Composition A | Composition B |
|---|---|---|
| Mirasil ADM-E[1] | 5% | — |
| Ultratex SW[2] | — | 3% |
| SM2112[3] | 1% | — |
| Luvitec VPC[4] | — | 0.75% |
| Ammonium carbonate | 0.02% | — |
| Ammonium bicarbonate | — | 0.3% |
| Silwet L 7200[5] | 3% | — |
| Radiasurf 7137[6] | — | 5% |
| Silwet L 77[7] | 0.75% | 1% |
| Velustrol P-40[8] | 2.25% | — |
| Emulsifier[9] | 0.6% | 1.25% |
| Preservative | 3 ppm | 3 ppm |
| Perfume | 0.5% | 1% |
| Water | Balance | Balance |

[1]Microemulsified linear aminosilicone from Rhodia (34% active)
[2]Microemulsified linear aminosilicone from Ciba (14% active)
[3]Silanol-stopped cross-linked silicone emulsion from GE-Bayer Silicones (35% active)
[4]Co-polymer of vinylpyrrolidone and vinylcaprolactam from BASF (31% active)
[5]Polyalkylene oxide polysiloxane from Crompton (100% active)
[6]Polyethoxylated (20 moles) sorbitan monolaureate from Fina (100% active)
[7]Polyalkylene oxide polysiloxane from Crompton (100% active)
[8]Oxidezed polyolefin wax from Hoechst (41% active)
[9]CAE 10, coconut alcohol condensed with an average of 10 moles of ethylenoxide from Hoechst (100% active)

Each composition is contained in a manual trigger sprayer container, or in an aerosol container, or in an iron. The container is labeled with instructions, or accompanied with a leaflet bearing instructions to use the composition during the ironing process. Specifically, the composition is sprayed onto fabrics and the fabrics are ironed. The fabrics are less prone to dry-wrinkle formation than other fabrics which were ironed without having been sprayed with the exemplified composition.

Example 2

Composition in a Fabric Conditioner

| | Composition A |
|---|---|
| Rewoquat V3282[1] | 20% |
| SM2125[2] | 5.0% |
| Ammonium carbonate | 0.5% |
| $CaCl_2$ | 0.15% |
| Perfume | 0.75% |
| Dye solution | 0.025% |
| HEDP[3] | 0.02% |
| HCl | 0.02% |
| Water | Balance |

[1]DEEDMAC Diethylester dimethylammonium chloride from Crompton (85% active)
[2]Silanol-stopped amino-modified cross-linked silicone emulsion from GE-Bayer silicones (38% active)
[3]Hydroxyethylidene-1,1-diphosphonic acid from Albright and Wilson (59% active)

This composition is used to treat fabrics in the last rinse of a normal laundry cycle. The composition is contained in a container which is labeled with instructions, or accompanied with a leaflet bearing instructions to use the composition during the last rinse of a normal laundry cycle. The fabrics are then dried and ironed. Those fabrics are less prone to dry-wrinkle formation than other fabrics which were ironed without having been conditioned with the exemplified composition.

What is claimed is:

1. A composition for the treatment of fabrics comprising from about 0.001% to about 50%, by weight of said composition, of a film-forming material selected from the group consisting of shape retention polymers comprising silicon-containing monomers, polymers comprising silicone moieties, curable silicones, and mixtures thereof, and from about 0.01% to about 100%, by weight of said film-forming material, of a blowing agent selected from the group consisting of ammonium carbonate, ammonium bicarbonate, group 1 metal bicarbonates, and mixtures thereof; wherein said composition is contained in a sprayer, an aerosol, or a cartridge to be inserted in an iron for the dispensing of its content.

2. A process for the treatment of fabrics, the process comprising the steps of:

contacting said fabrics with a fabric treatment composition comprising from about 0.001% to about 50%, by weight of said composition, of a film-forming material selected from the group consisting of shape retention polymers comprising silicon-containing monomers, polymers comprising silicone moieties, curable silicones, and mixtures thereof, and from about 0.01% to about 100%, by weight of said film-forming material, of a blowing agent selected from the group consisting of ammonium carbonate, ammonium bicarbonate, group 1 metal bicarbonates, and mixtures thereof; and then ironing the fabrics.

3. A process according to claim 2, wherein said composition is contained in a sprayer, an aerosol, or a cartridge to be inserted in an iron for the dispensing of its content.

4. An article of manufacture comprising:

a composition comprising from about 0.001% to about 50%, by weight of said composition, of a film-forming material selected from the group consisting of shape retention polymers comprising silicon-containing monomers, polymers comprising silicone moieties, curable silicones, and mixtures thereof, and from about 0.01% to about 100%, by weight of said film-forming material, of a blowing agent selected from the group consisting of ammonium carbonate, ammonium bicarbonate, group 1 metal bicarbonates, and mixtures thereof; and usage instructions to use the composition in a fabric treatment process to provide dry wrinkle resistance to fabric.

5. An article according to claim 4, wherein the fabric treatment processes comprises the steps of providing fabrics with the composition, then ironing the fabrics.

6. An article according to claim 4, wherein said composition is contained in a sprayer, an aerosol, or a cartridge to be inserted in an iron for the dispensing of its content.

* * * * *